United States Patent [19]

Danielsson et al.

[11] 4,095,202

[45] June 13, 1978

[54] COIL FOR PRODUCING A HOMOGENEOUS MAGNETIC FIELD IN A CYLINDRICAL SPACE

[75] Inventors: Nils Allan Danielsson, Sollentuna, Sweden; Karl-Peter Christian Lindblom, Nagu, Finland

[73] Assignee: Applied Research Laboratories S.A., Ecublens, Switzerland

[21] Appl. No.: 631,876

[22] Filed: Nov. 14, 1975

[30] Foreign Application Priority Data

Dec. 20, 1974 Finland ..... 3738/74

[51] Int. Cl.[2] ..... H01F 5/00

[52] U.S. Cl. ..... 335/213; 335/299

[58] Field of Search ..... 335/213, 210, 299

[56] References Cited

U.S. PATENT DOCUMENTS 2,159,534 5/1939 Ruska ..... 335/210

*Primary Examiner*—Harold Broome

*Attorney, Agent, or Firm*—Biebel, French & Nauman

[57] ABSTRACT

The invention relates to a coil for producing in a cylindrical space a magnetic field being homogeneous in a direction parallel to the axis of said space, which coil comprises a cylindrical winding concentric with the cylindrical space and having at least one pair of mutually identical windings placed symmetrically with respect to the medial plane of the cylindrical winding perpendicular thereto, and extending in planes perpendicular to the longitudinal axis of the cylindrical winding. The pair of mutually identical windings may be situated at the opposite ends of the cylindrical winding and may have a closeness of winding higher than that of the cylindrical winding.

4 Claims, 4 Drawing Figures

COIL FOR PRODUCING A HOMOGENEOUS MAGNETIC FIELD IN A CYLINDRICAL SPACE

BACKGROUND OF THE INVENTION

It is known in prior art in connection with generation of a magnetic field in a substantially cylindrical space parallel to the axis of said space, to employ a coil wound on a cylindrical mantle surface concentric with the cylindrical space. Such coils of so-called solenoid shape are also commonly used for control, frequently including so-called focussing, of charged particles, such as electrons for instance. It is also a known fact that the greater the length of the solenoid in relation to its radius, the greater is the axial extension of the central homogeneous magnetic field. In order that an axial field displaying a high degree of homogeneity might be produced in a cylindrical space of given size, it is necessary that the length of the solenoid is considerably in excess of the length of the space in question. In numerous instances this is not practically feasible owing to space considerations.

SUMMARY OF THE INVENTION

The object of the present invention is to eliminate this drawback, that is to enable coils to be constructed which have a length not necessarily much in excess of the length of the cylindrical space wherein the homogeneous axial magnetic field is to be generated.

In accordance herewith, the invention is mainly characterized in that the coil comprises not less than two windings disposed in pairs symmetrically with reference to the central plane of the cylindrical winding perpendicular to its longitudinal axis and which are mutually identical, and which run in planes perpendicular or at least substantially perpendicular to the longitudinal axis of the cylindrical winding.

The invention shall be more closely described with reference to an embodiment example thereof, presented in the attached drawing and in connection therewith further features characteristic of the invention shall be presented.

SHORT DESCRIPTION OF THE DRAWING

In the drawing, FIG. 1 shows a coil according to the invention intended to produce a magnetic field which is axially homogeneous within a cylindrical space;

DESCRIPTION OF THE PREFERRED EMBODIMENT

Figure 1:
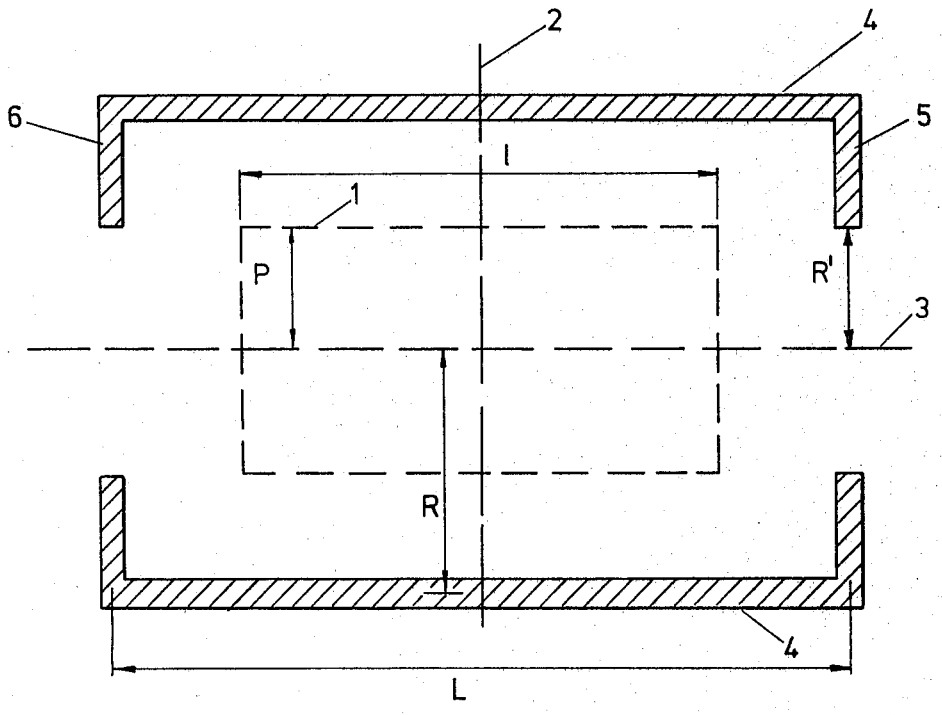

In FIG. 1, reference numeral 1 indicates a cylindrical space, schematically represented, its length being indicated by $l$ and its radius by $\rho$. The axis of the cylindrical space is indicated by 3, and numeral 2 indicates the central plane perpendicular to the axis 3, and which symmetrically divides the cylindrical space into two symmetrical parts. Around the cylindrical space a coil has been placed, wound of electrical conductors in circular loops, which approximately conform to planes perpendicular to the axis 3. The loops have been so disposed that the current flows in one and the same direction of rotation all the time. The coil shown in the drawing comprises a winding 4 placed on a cylindrical mantle surface, the axis of which coincides with the axis 3 of the cylindrical space. The mean radius of curvature of the cylindrical winding has been denoted with R. The cylindrical winding 4 has been so disposed with reference to the central plane 2 that this plane divides the winding 4 symmetrically into two identical parts. The axial extension of the cylindrical winding 4 has been denoted with L. The coil also comprises two identical windings indicated by 5 and 6, provided in association with the ends of the cylindrical winding 4. It is understood that the identical windings 5 and 6 are symmetrically placed with reference to the central plane 2 at a distance L from each other, and both windings 5 and 6 run in planes perpendicular to the axis 3. As can be seen From FIG. 1, the cylindrical winding 4 has a substantially axial extension and a minor radial extension. The symmetrical end windings 5 and 6, in contrast, have a substantially radial extension and minor axial extension.

Figure 2:
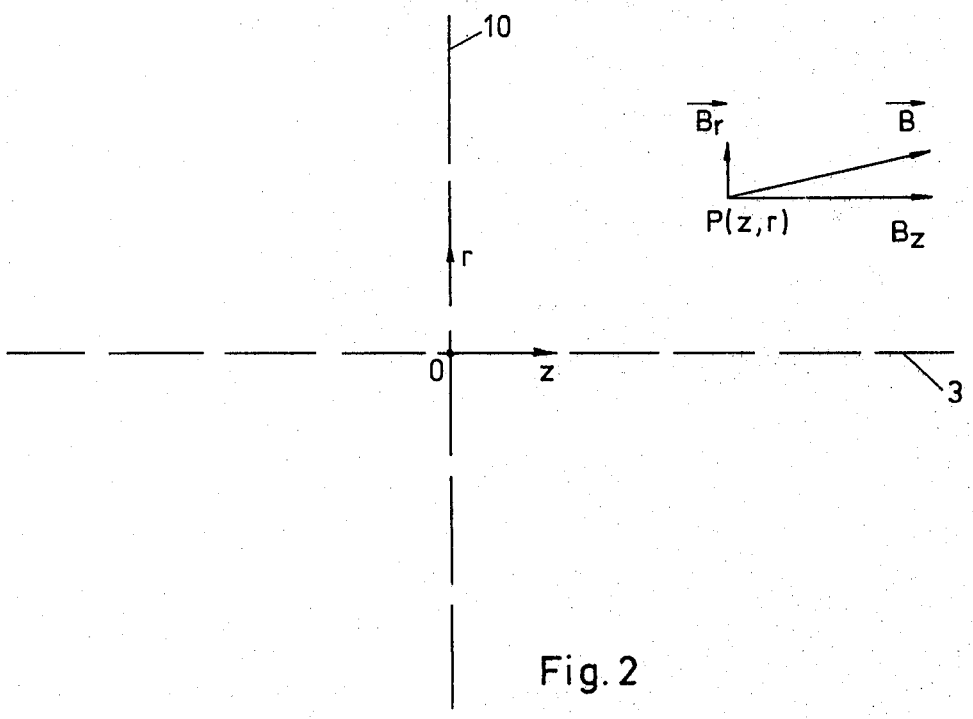
FIG. 2 is a view of a section of the coil of FIG. 1, sectioned by a plane passing through the axis of the cylindrical space.

Since the magnetic field is gererated by circular, concentric paths of current, it will be, as regards its magnitude and direction, a function merely of the axial position and of the radial distance from the axis 3. The magnetic field strength vector, denoted with $\vec{B}$ (FIG. 2), always lies in a plane passing through the cylinder axis 3. It is therefore sufficient to study the magnetic field in an arbitrary such plane. FIG. 2 shows a section through the coil of FIG. 1, with an arbitrarily chosen sectioning plane passing through the axis 3. The line of intersection of the central plane 2 shown in FIG. 1 and the sectioning plane shown in FIG. 2 has been indicated by 10 in FIG. 2. The intersection of the axis 3 and the line 10 carries the symbol 0 in FIG. 2, and this point is the origin of a system of coordinates so chosen that the coordinate axis denoted with Z, or the Z axis, runs along the cylinder axis 3, and the axis denoted with $r$, or the $r$ axis, runs along the line 10. The coordinate $r$ may only assume positive values. In FIG. 2 P denotes an arbitrarily chosen point in the sectioning plane passing through the cylinder axis 3 which is shown in the same figure. The position of the point P is unambiguously fixed by its coordinates ($z$ and $r$) in the said system of coordinates. The arrow denoted with $\vec{B}$ gives the magnitude and direction of the magnetic field strength vector at P. There has further been entered another arrow $\vec{B}_r$ in FIG. 2, indicating the component in the direction of the $r$ axis of the magnetic field strength vector $\vec{B}$, and furthermore still another arrow $\vec{B}_z$, indicating the component in the direction of the $z$ axis of the magnetic field strength vector $\vec{B}$. Using these notations, the following relationship is found:

$$\vec{B}(r,z) = \vec{B}_r(r,z) + \vec{B}_z(r,z) \qquad (I)$$

wherein $(r,z)$ indicates that the magnetic field strenth vector $\vec{B}$, and its components $\vec{B}_r$ and $\vec{B}_z$, depend on the coordinates of the point P with regard to the system of coordinates shown in FIG. 2. Referring to formula (I), it would be desirable to be able to shape the winding of the coil so that the component $\vec{B}_r = 0$ and $\vec{B}_z =$ constant for all $r$ and $z$ values within the cylindrical space 1 indicated in FIG. 1. However, this desirable end can never be altogether exactly achieved in practice.

Since the central plane 2 shown in FIG. 2 divides the coil into two symmentrical halves, it suffices to study the magnetic field strength vector with positive values of the coordinates $r$ and $z$ only.

Starting from well-known physical laws, it is possible to calculate the magnetic field generated by the coil. This may be accomplished e.g. by numerical data calculations.

The field generated by the coil has the following general properties. Owing to reasons of symmetry, the radial magnetic field strength component $\vec{B}_r = 0$ along the axis 3 of the cylindrical space, i.e. the magnetic field strength vector $\vec{B}$ is axially oriented. The magnetic field strength vector $\vec{B}$ is likewise axially oriented if the point P in FIG. 2 lies in the symmetry plane 2 in FIG. 1. Therefore, $$\vec{B}(r,z) = \vec{B}_z(r,z) \quad \begin{array}{l} \text{for } r = 0 \text{ and for any } z \\ \text{for } z = 0 \text{ and for any } r \end{array}$$

The coil shown in FIG. 1 has been so wound that the cylindrical winding 4, in cross sections of same, has equal density of electrical conductors, through which the same current flows, referred to unit length of the mantle of the winding 4 in axial direction. If in this connection the thickness of the electrical conductors, and thereby the radial extension of the cylindrical winding 4, is neglected, it can be said that the axial current density of the current flowing along the cylinder mantle surface in planes perpendicular to the cylinder axis, that is the current per axial unit length of the cylinder mantle surface, is constant over the whole cylindrical winding. In the following this current density shall be referred to by the symbol $i$.

The constant axial current density in the cylindrical winding is due to the fact that the winding is produced of a continuous electrical conductor uniformly wound on the cylinder mantle surface. Moreover, the coil shown in FIG. 1 has been wound so that the identical end windings 5 and 6 have mutually equal density of electrical conductors, through which flows the same current, calculated per unit length of the winding's radial extension. This also implies that the radial current density of the current flowing in a circular current path in a plane perpendicular to the cylinder axis, that is the current per unit length in the radial direction, is constant. This is due to the fact that the end winding 5, or 6 respectively, has been wound of a continuous electrical conductor and that the thickness of this conductor in the end winding 5 equals the thickness of the continuous wire of which the end winding 6 has been wound. However, the mutually equal constant current density in the end windings, in the radial direction, need not equal the axial constant current density in the cylindrical winding 4. This is because the end windings 5 and 6, respectively, may be wound of a conductor having a thickness deviating from the conductor thickness of which the cylindrical winding has been wound. A relation which holds for the coil shown in FIG. 1 is that the radial current density of the end windings 5 and 6 is $= f \times i$, wherein $f$ is a dimensionless constant stating the ratio of the radial current density in the end windings 5 and 6 and the axial current density $i$ in the cylindrical winding 4.

For a coil according to the invention the parameters, namely, the radius of curvature R of the cylindrical winding 4, its length L and the least radius of curvature R′ of the end windings, are determined by evaluations based on practical considerations, which are related to the size and shape of the cylindrical space 1, and further to the degree of homogeneity which shall be achieved in said cylindrical space. If there are no other inhibiting reasons, it is a valid rule of thumb that the radius of curvature R of the cylindrical winding 4 exceeds by a factor at least equal to 3 the radius of curvature $\rho$ of the cylindrical space 1, so that a high degree of homogeneity may be achieved.

The length L of the coil is partly determined by the above, but it is also often restricted by purely geometrical circumstances.

The least radius of curvature R′ of the symmetrical end windings is approximately always determined by the size of the members which shall be acted upon by the magnetic field which the coil generates, and which member therefore shall be introducable into the magnetic field. It is a rule of thumb for the choice of this radius of curvature that it shall be chosen as small as possible. In the majority of cases this implies that R′ will be larger than the radius of curvature of the cylindrical space.

As a conclusion from the above discussion it may be said that the parameters mentioned, the radius of curvature R of the coil, its length L and the least radius of curvature R′ of the end windings, are most often fixed in advance whithin comparatively narrow limits.

There remains then the optimum choice of the above-mentioned parameter $f$ for achievement of as homogeneous magnetic fields as possible within the cylindrical space 1.

In order to give a concrete illustration of the invention, numerical data are stated in the following, referring to a coil of the design shown in FIG. 1, constructed in accordance with the invention.

With this coil it is intended to produce a homogeneous field of 25 Gauss units in a cylindrical space having the radius $\rho = 22$ mm and the length $l = 220$ mm. The total variation in field strength within the whole of this cylindrical space must not exceed 2 percent units. Owing to space considerations prescribed by the use of the coil the following data are chosen for the coil: coil length $L = 360$ mm, its radius $R = 85$ mm, and least radius of curvature of the end windings R′ = 45 mm. Optimation with the aid of computer reveals that in this coil the above-specified factor $f$, stating the ratio between the winding densities of the coil's end windings and of the cylindrical winding, shall be 1.3. The coil shall be energized from a current source with a 2 amp. current. The cylindrical part 4 of the coil is in this instance wound to have 383 turns of conductive wire uniformly distributed over the whole cylindrical part. Both end parts 5,6 shall then be wound each with 55 turns of conductor wire, uniformly distributed in the radial direction from the smallest radius of curvature (45 mm) up to the radius of curvature of the cylindrical part (85 mm).

Figure 3:
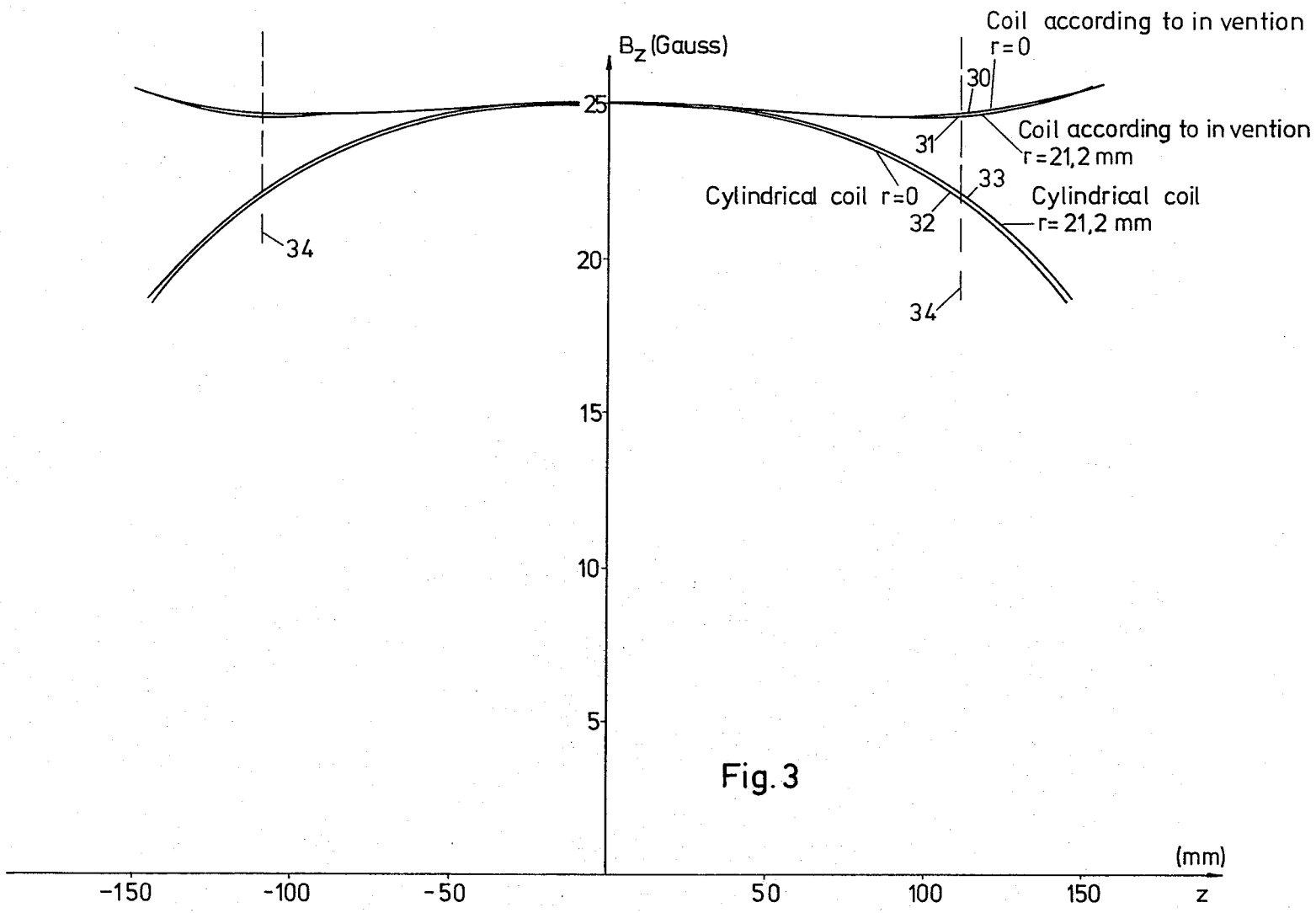
FIG. 3 is a diagram showing the distribution of the axial magnetic field strength component of a coil according to the invention.

In order to illustrate the result obtained with the coil according to the invention which has just been described, FIG. 3 shows a diagram concerning the distribution of the axial magnetic field strength $\vec{B}_z$ as a function of the coordinate $z$. In FIG. 3 the curve 30 reveals the distribution of the said component along the coil axis ($r = 0$), while the curve 31 reveals the distribution of the magnetic field strength component $\vec{B}_z$ at a constant $r$ coordinate value, equalling 21.2 mm. For the sake of comparison, in the same figure the corresponding distributions have been entered which relate to a coil having only a cylindrical winding with radius of curvature R and length L the same as in the coil according to the invention and the winding density so adjusted that the coil generates the same field strength as the central point 0 as the coil according to the invention. The curve of the cylindrical coil corresponding to curve 30 has been denoted with 32, and the curve corresponding to curve 31 bears the notation 33. In FIG. 3 also interrupted vertical lines 34 have been entered, which indicate the limits of extension along the axis of the cylindrical space 1 in FIG. 1.

Figure 4:
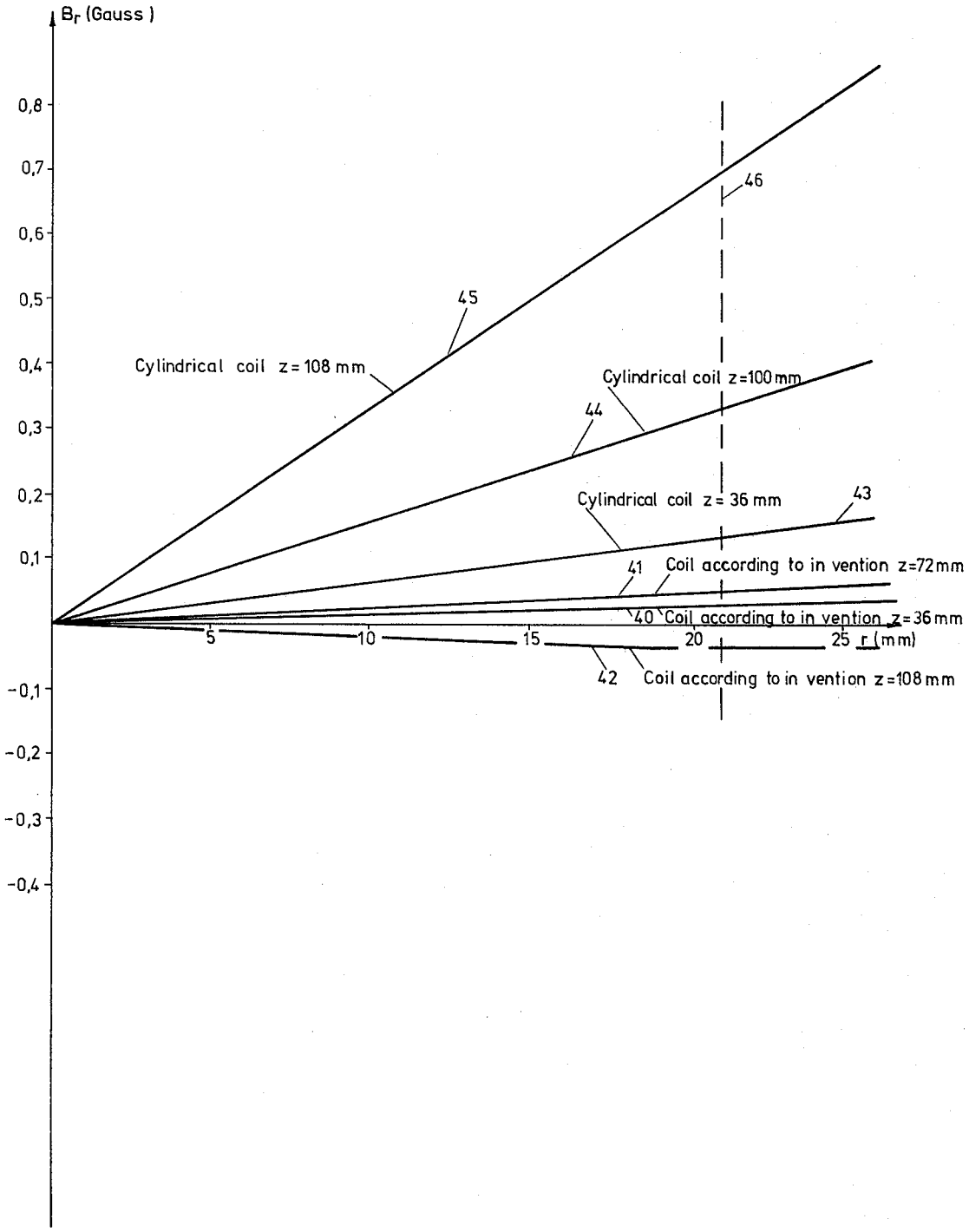
FIG. 4 is a diagram showing the distribution of the radial magnetic field strength component of the same coil according to the invention.

In FIG. 4 a diagram has been reproduced which shows the distribution of the radial magnetic field component $\vec{B}_r$ as a function of the radial coordinate $r$ for the coil according to the invention. Thus, the curve 40 shows the distribution of the component $\vec{B}_r$ with $z = 36$ mm, the curve 41 the distribution with $z = 72$ mm, and the curve 42 that with $z = 108$ mm. In the same figure the corresponding distribution curves of the above-mentioned coil with cylindrical winding only have also been entered. The curve of the cylindrical coil corresponding to the distribution curve 40 has been denoted with 43, the curve corresponding to 41 has been denoted with 44, and that corresponding to 42, with 45. In FIG. 4 an interrupted vertical line 46 has also been entered, which indicates the limit of the adial extension of the cylindrical space.

Comparison of the distribution curves 30 and 31 in FIG. 3 with the corresponding distribution curves 32 and 33 illustrates the degree of homogenisation of the magnetic field that is achieved by the aid of the invention. It is seen from the distribution curves 30 and 31 from the limiting line 34 that with the coil according to the invention within the entire cylindrical space 1 a magnetic field has been obtained the maximum field strength variation of which does not exceed the above-specified required limit of 2 percent units. On the other hand, the curves 32 and 33 relating to the coil having only a cylindrical winding reveal a maximum field strength variation amounting to about 13 percent units, in the cylindrical space.

The invention is not confined to the embodiment described in the foregoing and shown in the drawing, and it may be varied in a number of ways within the scope of the invention. For instance, the coil may be composed of two or more cylindrical windings in combination with one or several pairs of mutually identical radial windings. The radial windings, symmetrical two and two, may also be disposed at points of the cylindrical winding other than the ends thereof.

What is claimed is:

1. Coil for producing in a substantially cylindrical space a homogeneous magnetic field in a direction parallel to the axis of said cylindrical space, comprising at least one substantially cylindrical winding concentric with said cylindrical space, having a length exceeding that of said cylindrical space and having a substantially constant winding density over its longitudinal extension, said coil further comprising at least one pair of mutually identical windings disposed symmetrically with reference to a plane perpendicular to the longitudinal axis of said cylindrical winding through the centre thereof, extending in planes substantially perpendicular to the longitudinal axis of said cylindrical winding inwardly therefrom to a minimum radius being larger than the radius of said cylindrical space, and having a substantially constant winding density over their radial extension.

2. Coil as in claim 1, wherein said windings symmetrical in pairs consist of two windings situated at the opposite ends of said cylindrical winding.

3. Coil as in claim 1, wherein said windings symmetrical in pairs have a winding density differing from that of said cylindrical winding.

4. Coil as in claim 3, wherein said windings symmetrical in pairs have a winding density higher than that of said cylindrical winding.

* * * * *